US006026718A

United States Patent [19]

Anderson

[11] Patent Number: 6,026,718

[45] **Date of Patent: *Feb. 22, 2000**

[54] HIGH ENERGY MAGNETIZER AND SELECTIVE DEMAGNETIZER INTEGRAL WITH DRIVER TOOL OR THE LIKE

[76] Inventor: Wayne Anderson, 65 Grove St., Northport, N.Y. 11729

[ * ] Notice: This patent is subject to a terminal disclaimer.

[21] Appl. No.: 09/161,855

[22] Filed: Sep. 28, 1998

[51] Int. Cl.[7] ..... B25B 23/08

[52] U.S. Cl. ..... 81/451; 81/125

[58] Field of Search ..... 81/125, 451; 7/125

[56] References Cited

U.S. PATENT DOCUMENTS

| | | |
|---|---|---|
| 512,381 | 1/1894 | Keyes . |
| 608,555 | 8/1898 | Nazel . |
| 1,587,647 | 6/1926 | Hood et al. . |
| 1,619,744 | 3/1927 | McCloskey . |
| 2,174,327 | 9/1939 | Love . |
| 2,260,055 | 10/1941 | Reardon . |
| 2,300,308 | 10/1942 | Ojalvo . |
| 2,624,223 | 1/1953 | Clark . |
| 2,630,036 | 3/1953 | Brown . |
| 2,653,636 | 9/1953 | Younkin . |
| 2,666,201 | 1/1954 | Van Orden . |
| 2,671,369 | 3/1954 | Clark . |
| 2,671,484 | 3/1954 | Clark . |
| 2,677,294 | 5/1954 | Clark . |
| 2,678,578 | 5/1954 | Bonanno . |
| 2,688,991 | 9/1954 | Doyle . |
| 2,718,806 | 9/1955 | Clark . |
| 2,720,804 | 10/1955 | Brown . |
| 2,750,828 | 6/1956 | Wendling . |
| 2,758,494 | 8/1956 | Jenkins . |
| 2,782,822 | 2/1957 | Clark . |
| 2,793,552 | 5/1957 | Clark . |
| 2,834,241 | 5/1958 | Chowning . |
| 3,007,504 | 11/1961 | Clark . |
| 3,126,774 | 3/1964 | Carr et al. . |
| 3,253,626 | 5/1966 | Stillwagon, Jr. et al. . |
| 3,320,563 | 5/1967 | Clark . |
| 3,392,767 | 7/1968 | Stillwagon, Jr. . |
| 3,467,926 | 9/1969 | Smith . |

(List continued on next page.)

FOREIGN PATENT DOCUMENTS

| | | |
|---|---|---|
| 869431 | 5/1961 | United Kingdom . |

*Primary Examiner*—James G. Smith
*Attorney, Agent, or Firm*—Lackenbach Siegel Marzullo & Aronson

[57] ABSTRACT

A magnetizer/demagnetizer for integration with a non-operative portion of a hand-held driving tool or the like includes an elongate handle which defines a tool axis and is suitably shaped and dimensioned to be graspable within the hand of the user. The driving tool may be in the form of a fixed, precision or other drivers in which the driver members, such as flat blade and Phillips screwdriver tips are mounted at one axial end of the handle. The handle defines a driver axis generally coaxially aligned with the tool axis. The driving tool has at least one permanent magnet provided on the handle, the magnet being formed of a magnetized material having north and south poles defining a magnetic axis generally arranged on the handle to permit selective placement of a magnetizable element at at least one position along the magnetic axis at a predetermined distance from one of the poles to magnetize the element and placement of the element at one of a plurality of selected distances each greater than such predetermined distance of the other of the poles to demagnetize the element. Indicia, such as grooves, notches or steps, are provided on the non-operative portion of the driving tool or the like for providing an indication of a desired or preferred position for placement of the magnetizable element to be demagnetized. The magnetic axis is either aligned with or offset from the driver axis. In this way, a magnetizable element of a given size may be initially magnetized by positioning same adjacent to one of the poles and subsequently substantially or fully demagnetized by positioning the magnetizable element a selected distance from the other of the poles as indicated by the indicia. The magnets used have an energy product equal to at least $7.0\times10^6$ gauss-oersteds.

29 Claims, 5 Drawing Sheets

U.S. PATENT DOCUMENTS

| | | |
|---|---|---|
| 3,630,108 | 12/1971 | Stillwagon, Jr. . |
| 3,662,303 | 5/1972 | Arllof . |
| 3,707,394 | 12/1972 | Stillwagon, Jr. . |
| 3,869,945 | 3/1975 | Zerver . |
| 3,884,282 | 5/1975 | Dobrosielski . |
| 4,219,062 | 8/1980 | Berkman . |
| 4,393,363 | 7/1983 | Iwasaki . |
| 4,827,812 | 5/1989 | Markovetz . |
| 5,000,064 | 3/1991 | McMahon . |
| 5,038,435 | 8/1991 | Crawford et al. . |
| 5,178,048 | 1/1993 | Matechuk . |
| 5,210,895 | 5/1993 | Hull et al. . |
| 5,259,277 | 11/1993 | Zurbuchen . |
| 5,577,426 | 11/1996 | Eggert et al. . |
| 5,794,497 | 8/1998 | Anderson ..... 81/451 |

HIGH ENERGY MAGNETIZER AND SELECTIVE DEMAGNETIZER INTEGRAL WITH DRIVER TOOL OR THE LIKE

BACKGROUND OF THE INVENTION

1. Field of the Invention

The present invention generally relates to tools, and more specifically to a driver tool and attachment which embodies a high energy permanent magnet magnetizer and a selective demagnetizer for selectively magnetizing and/or demagnetizing a magnetizable element, such as a driver bit, fastener, and the like.

2. Description of the Prior Art

It is frequently desirable to magnetize the tips of screwdriver bits, tweezers and the like to form at a least temporary magnetic pole on the tool which attracts magnetizable elements. Thus, particularly with precision screwdrivers which tend to be relatively small and are used to drive relatively small screws, it is frequently advantageous to at least temporarily magnetize the screwdriver tips of the driver bits to maintain the screwdriver tip blade within the slot of a head of a screw or a Phillips driver within the cross slots formed within the head of the screw adapted to receive the Phillips screwdriver tip. By magnetizing the tip of the driver bit, and mating the tip within the associated opening in the head of the screw, the screw remains attached to the bit tip without the need to physically hold them together. This allows the screw to be guided through a relatively small bore or channel and moved within confined spaces. Sometimes the magnetized tip of the driver bit is used to retrieve a metal item, such as a screw, washer, nail or the like, from an inaccessible place which would otherwise be difficult to reach with anything but a relatively thin shank of a bit driver. Of course, such attachment of a fastener to the driver bit tip also frees one hand for holding or positioning the work into which the fastener is to be driven. In some instances, rather than magnetizing the tip of the driver member bit, the fastener itself is magnetized so that, again, it is attracted to and remains magnetically attached to the driver bit tip in the same way as if the latter had been magnetized.

Conversely, there are instances in which a magnetized driver bit tip is a disadvantage, because it undesirably attracts and attaches to itself various magnetizable elements or components. Under such circumstances, it may be desirable to demagnetize a driver bit tip that had been originally magnetized in order to render same magnetically neutral.

Devices for magnetizing/demagnetizing tools and small parts are well known. These normally incorporate one or more permanent magnets which create a sufficiently high magnetic field to magnetize at least a portion of a magnetizable element brought into its field. The body can be magnetized by bringing it into the magnetic field. While the magnetic properties of all materials make them respondent in some way to magnetic fields, most materials are diamagnetic or paramagnetic and show almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Hard materials are used to supply fixed fields either to act alone, as in a magnetic separator, or interact with others, as in loudspeakers, electronic instruments and test equipment.

Most magnetizers/demagnetizers include commercial magnets which are formed of either Alnico or of ceramic materials. The driver members/fasteners, on the other hand, are normally made of soft materials which are readily magnetized but more easily lose their magnetization, such as by being drawn over an iron or steel surface, subjected to a demagnetizing influence such as strong electromagnetic fields or other permanent magnetic fields, severe mechanical shock or extreme temperature variations.

One example of a stand alone magnetizer/demagnetizer is magnetizer/demagnetizer Model No. 40010, made in Germany by Wiha. This unit consists of a plastic box that has two adjacent openings defined by three spaced transverse portions. Magnets are placed within the transverse portions to provide magnetic fields in each of the two openings which are directed in substantially opposing directions. Therefore, when a magnetizable tool bit or any magnetizable component is placed within one of the openings, it becomes magnetized and when placed in the other of the openings, it becomes demagnetized. The demagnetizing window is provided with progressive steps to stepwise decrease the air gap for the demagnetizing field and, therefore, provides different levels of strengths of the demagnetizing field. However, common magnetic materials that are used with conventional magnetizers/demagnetizers include Alnico and ceramic magnets which typically have energy products equal to approximately $4.5\times10^6$ gauss-oersteds and $2.2\times10^6$ gauss-oersteds, respectively.

Since the magnetic field strength "B" at the pole of the magnet is a product of the unit field strength and the area, it follows that the energy content is proportional to the BH product of the magnet. The BH product is a quantity of importance for a permanent magnet and is probably the best single "figure of merit" or criterion for judging the quality of the permanent magnetic material. It is for this reason that conventional magnetizers/demagnetizers have required significant volumes of magnetic material to provide the desired energy content suitable for magnetizing and demagnetizing parts. However, the required volumes have rendered it impossible or impractical to incorporate the magnetizers/demagnetizers on relatively small hand tools. Thus, for example, precision screwdrivers, which are relatively small and have relatively small diameter handles, could not possibly incorporate sufficient magnetic material to provide desired levels of magnetic fields for magnetizing and demagnetizing parts. However, the requirement of using separate magnetizer/demagnetizer units has rendered their use less practical. Thus, unless the user of a precision screwdriver or any driver tool acquired a separate magnetizer/demagnetizer, one would not normally be available for use. Additionally, even if such magnetizer/demagnetizer were available, it would still require a separate component that could be misplaced and not be available when needed. Additionally, there is always the risk that the magnetizer/demagnetizer could become misplaced or lost, rendering the use of the driver tool less useful.

Another problem with prior art magnetizers/demagnetizers is that they fail to address the problem that during "demagnetization" the element being demagnetized may be either insufficiently demagnetized or overly demagnetized to effectively re-magnetize the element with opposing polarity. Thus, prior art magnetizers/demagnetizers have failed to consider the importance of the strengths of the magnets and the sizes of the elements being magnetized and demagnetized. Thus, typically, the larger the element, the more magnetic field required to demagnetize it. However, demagnetization of all sized elements within the same field may result in some elements being insufficiently demagnetized, while others become overly demagnetized. In either case, the end result is unsatisfactory in that an element which was intended to be demagnetized continues to exhibit magnetic poles and generate a magnetic field.

SUMMARY OF THE INVENTION

It is an object of the present invention to provide a high energy magnetizer and selective demagnetizer on a driver tool or the like.

It is another object of the present invention to provide a magnetizer/demagnetizer as aforementioned which provides sufficiently strong magnetic fields to effectively and adequately magnetize/demagnetize a driver bit and/or a magnetizable component.

It is still another object of the present invention to provide a magnetizer/demagnetizer as in the previous objects in which the magnetizing and demagnetizing fields are created proximate to the surface of a handle of a driver tool.

It is yet another object of the present invention to provide a tool as in the previous objects in which the handle is provided with one or more openings within the handle in which the magnetizing and/or demagnetizing fields are formed for convenient and reliable magnetization and/or demagnetization.

It is a further object of the present invention to provide a magnetizer/demagnetizer as in the previous object in which spaced indicia are provided in relation to the demagnetizing magnet pole to indicate selected positions for a driver bit or other magnetized element to be placed in a demagnetizing field suitable to provide desired demagnetization.

It is yet a further object of the present invention to provide a magnetizer/demagnetizer which uses a permanent magnetic material having an energy product equal to at least $7.0\times10^6$ gauss-oersteds.

In order to achieve the above objects, as well as others which will become apparent hereinafter, a high energy magnetizer/demagnetizer for integration with a non-operative portion of a driving tool or the like comprises at least one permanent magnet formed of a magnetized material having north and south poles defining a magnetic axis and arranged on the non-operative portion of the driving tool or the like to permit selective placement of a magnetizable element at at least one position along said magnetic axis at a predetermined distance from one of said poles to magnetize the element and placement of the magnetizable element at one of a plurality of selected distances from the other of said magnetic poles. Each of said selected distances being greater than said predetermined distance to selectively demagnetize the element. Indicia means is provided on said non-operative portion of the driving tool or the like for providing an indication of a desired or preferred position for placement of the magnetizable element to be demagnetized as a function of the relative size of the portion of the magnetizable element to be demagnetized. In this manner, a magnetizable element of a given size may be initially magnetized by positioning same adjacent to said one pole mounted on the non-operative portion of the driving tool or the like and subsequently substantially or fully demagnetized by positioning the magnetizable element at a selected distance from the other of said poles as indicated by said indicia means.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
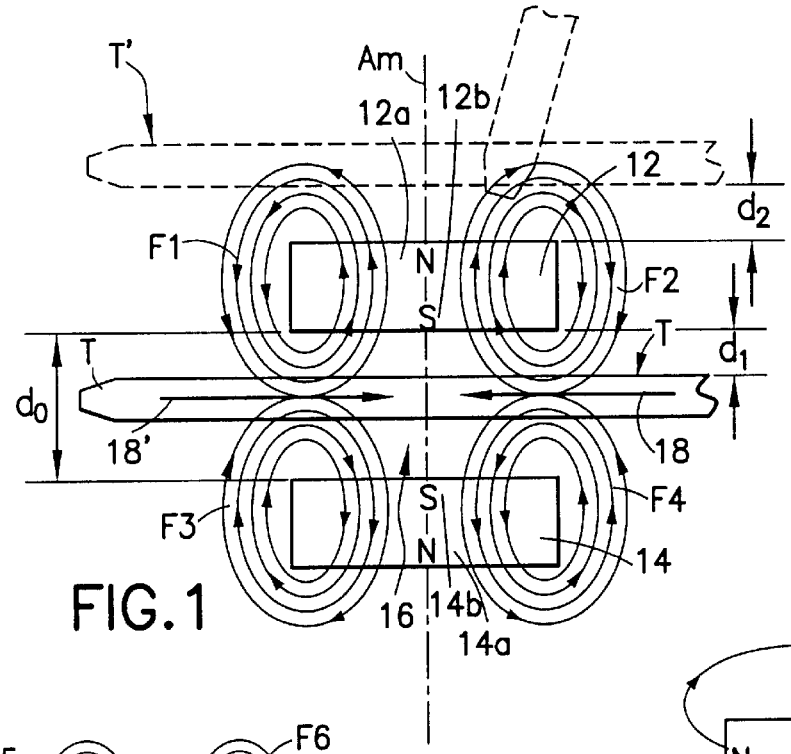
FIG. 1 is a schematic representation of the magnetic fields in the vicinity of two spaced magnets generally aligned along their magnetic axes, and showing a shank of a driver tool, such as a screwdriver shank, passed through the space between the magnets, in solid outline, to magnetize the shank, and also showing, in dashed outline, the same driver shank positioned adjacent to an opposite the pole, to demagnetize the shank.

Referring now specifically to the Figs., in which identical or similar parts are designated by the same reference numerals throughout, and first referring to FIG. 1, an arrangement of magnets to be used to achieve the objects of the present invention is generally designated by the reference numeral 10. The arrangement includes two spaced magnets 12, 14 spaced from each other a distance $d_0$ such that the magnetic poles of the two magnets are generally aligned with each other along a magnetic axis $A_m$. In FIG. 1, the poles facing each other are the same or similar poles, in the example shown these being south poles "S". Because similar poles of magnets repel each other, it will be evident that the resulting magnetic fields surrounding these magnets will be as depicted in FIG. 1, fields F1 and F2 being diametrically opposing cross sections of a generally continuous field in the shape of a torus surrounding the upper magnet 12 and symmetrically arranged about the magnetic axis $A_m$. Similarly, fields F3 and F4 are cross sectional images of a correspondingly shaped toroidal field symmetrically arranged about the magnetic axis $A_m$ in relation to the lower magnet 14. In the presently preferred embodiments, the magnets 12, 14 are "pill" magnets in the shape of circular cylindrical discs, the axes of symmetry of which coincide along the magnetic axis $A_m$. However, it will be evident to those skilled in the art that the specific shapes of the "cylinders" are not critical and discs having configurations other than circular discs may be used, with different degrees of advantage.

The spaced magnets 12, 14 create a region 16 between these magnets in which the upper and lower fields reinforce each other in the region 16 to produce magnetic components 18, 18' that are radially inwardly directed at diametrically opposite sides of the fields, as shown in FIG. 1. It will be evident, therefore, that a tool T inserted into the space 16 will experience localized fields that are significantly stronger than the fields generated by either one of the magnets and will be roughly twice the strength of the fields generated by either one of the magnets. Additionally, while the idealized representation in FIG. 1 suggests that the magnetic field will be enhanced or magnified only about the peripheries of magnets 12, 14, it will also be evident that an enhanced field will also be generated throughout the space 16.

With a field configuration as depicted in FIG. 1, it will be evident that the insertion of an elongate shank "T" of a driver, such as a screwdriver, drill bit, etc., into the space 16 will experience field reversals as the shank is introduced radially, in relation to the axis $A_m$, from one side of the magnets, through the axis $A_m$ and ultimately out through the diametrically opposite side. In the example illustrated, if a screwdriver is initially inserted from the right-hand side, as viewed in FIG. 1, the tip portion T1 of the driver shank T will initially experience the component 18 which is directed toward the left. As that portion T1 of the shank approaches the magnetic axis $A_m$ (at T2), the magnetic field is relatively neutral, or virtually nonexistent. When the portion T1 of the tool shank passes towards the left through the fields F1 and F3 it will experience a magnetic component 18' and generally directed towards the right. At the same time, an upstream portion T3 of the shank, passing through the fields F2, F4 will experience the component 18 toward the left. If the shank T does not proceed further towards the right than illustrated in FIG. 1, there will be upstream portions of the shank, beyond T3, that will not experience the strong magnetic forces created by the magnets 12, 14. As a result of the reversals of the directions of the magnetic fields by the components 18, 18', it will be evident that different portions of the shank T will initially be magnetized in one direction and be subsequently magnetized in an opposing direction. Such reversals in magnetization will continue as the shank T moves through the composite field towards the left when the tool is initially introduced between the magnets, and ultimately moved towards the right when the tool is withdrawn from the space 16. It will also be evident that although the tip T1 of the shank T will initially be magnetized when it is introduced into the space 16 from the right, it will also be the last portion of the shank T to be magnetically altered as it is the last portion to be withdrawn from the space 16 as the tool shank T is moved towards the right.

As will be more fully discussed in connection with FIG. 10, since the magnetic components 18, 18' are extremely strong, the last magnetic component that acts on any portion of the shank will demagnetize any previously magnetized portion and may, depending on the parameters, remagnetize that magnetizable portion consistent with the directions of the magnetic components. In FIG. 1, since the magnetic component 18 is the last component to be experienced by the tip T1 of the driver shank, the removal of that tip portion from the space 16 by movement of the shank towards the right will cause the magnetic component 18 to magnetize the tip T1 with a north pole "N". Therefore, the strong magnetic field within the space 16 will strongly magnetize the tip T1 of the shank T. To demagnetize the tip, when desired or necessary, requires that the tip T1 of the shank be placed within a field in which the field lines are reversed within the tip portion so that the field lines enter instead of leave the tip portion. This can be done by swiping or passing the tip portion T' across an opposite pole, here along the north pole "N" of the upper magnet 12. When the shank T is swiped adjacent the north pole N, as illustrated in dashed outline at T', and the shank is moved from left to right, it will be evident that the upper part of the field F2 will flow in the desired direction within the tip of the driver to effectively demagnetize that tip, in whole or in part, or remagnetize it with an opposing polarity. For reasons which will be more fully discussed in connection with FIG. 10, one feature of the present invention consists of the relative spacings $d_1$, $d_2$ of the driver shank from the initial magnetizing pole "S" and from the demagnetizing pole "N", respectively, such that magnetization of the tool will be assured and efficient, while demagnetization will be substantially complete while avoiding remagnetization with an opposing polarity. As will be evident from the discussion of FIG. 10, the magnetic force required to magnetize a magnetizable material is significantly greater than the magnetic force required to demagnetize that material. A feature of the invention, therefore, is the arrangement of the magnet or magnets in such a way that will position the shank T of the tool to be magnetized closer to the magnetizing pole face than to the demagnetizing pole face. In FIG. 1, this can be established by selecting the distance $d_1$ to be smaller than the distance $d_2$. While the specific distances $d_1$ and $d_2$ are not critical, they should be selected to generally correspond to the magnetizing and demagnetizing forces required to magnetize and demagnetize a specific tool shank T, this being a function both of the size of the shank as well as the specific material from which it is made. The material is important because, as will be evident from FIG. 10, different materials exhibit different magnetic properties, requiring different magnetic intensities or magnetizing forces to produce the same magnitudes of magnetic field or magnetic flux. The dimensions of the material to be magnetized is also important, because the more volume that the tool shank exhibits, the greater the magnetic field that will be required since what is instrumental in magnetizing or demagnetizing the material is not only the absolute intensity of the magnetic field but also the relative density of the field taken across a given cross sectional area of the tool or magnetizable material. In the case of the shank of a screwdriver, for example, the larger the diameter of the shank, the smaller the relative density of the magnetic field for a given amount of available magnetic flux. Therefore, in order to magnetize or demagnetize magnetic materials that are not saturated generally requires magnetic field levels consistent with the geometric dimensions of the shanks.

Figure 1A:
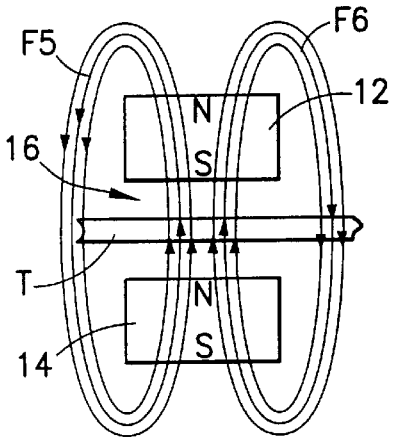
FIG. 1A is generally similar to FIG. 1, but showing a schematic representation of the magnetic fields when the two spaced magnets have their opposing poles facing each other.

In FIG. 1A, a different field configuration is established in the space 16. By flipping the magnet 14 around by 180°, the positions of the poles "N" and "S" are reversed, so that opposite poles now face each other across the gap of the space 16. Since the facing poles now attract, an enlarged field is formed including diametrically opposite sections F5, F6 of a toroidal field symmetrically arranged about the magnetic axis $A_m$. It will be clear that the field components that pass through the tool shank T are essentially perpendicular to the shank instead of being parallel as in FIG. 1. While there will be a number of field reversals as the shank T passes through the space 16, as viewed in FIG. 1A, the magnitude and orientations of the field have less of a magnetizing influence on the tool shank, and the arrangement is less effective than the arrangement shown in FIG. 1.

Figure 1B:
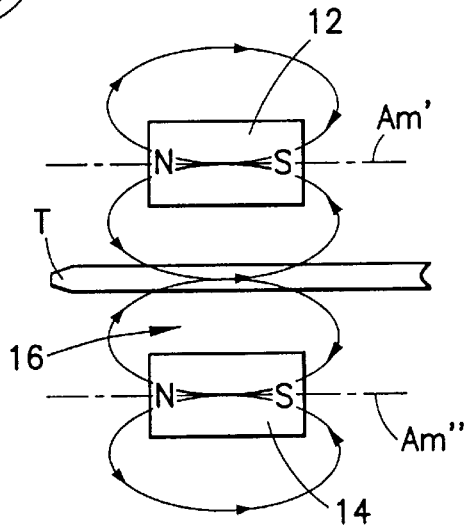
FIG. 1B is an alternative arrangement of the two spaced magnets in which similar poles face the same directions and the two magnetic axes are spaced but substantially parallel to each other.

In FIG. 1B, the two magnets 12, 14 are arranged so that their magnetic axes $A_m'$, $A_m''$ are parallel but offset from each other. The resulting field is similar in some respects to the field shown in FIG. 1, in which each magnet generates its own magnetic field, both fields reinforcing each other in the space 16 through which the tool shank T is passed. However, the field does not reverse as the shank passes through the space and continues to magnetize the shank in the same sense or polarity both when inserted as well as when withdrawn from the space 16. While the embodiment shown in FIG. 1 has been found to be most effective, the embodiments shown in FIGS. 1A and 1B may be used with different degrees of advantage.

Figure 2:
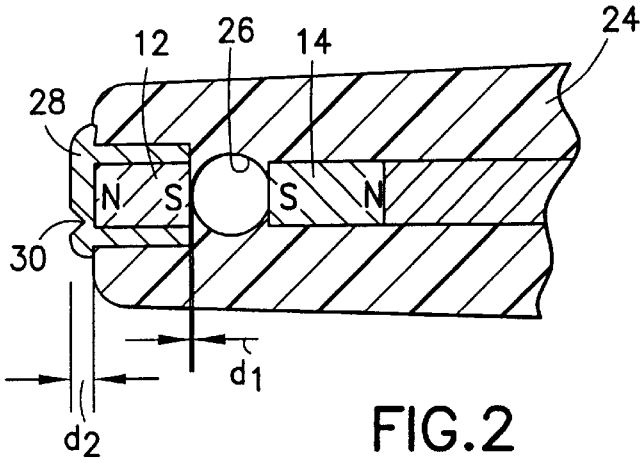
FIG. 2 is a fragmented cross sectional view of a handle of a screwdriver or the like, illustrating an embodiment of the invention, in which a hole is provided within the driver handle and two spaced magnets are arranged on diametrically opposite sides of the hole with their magnetic axes generally aligned or coextensive with the axis of the driver tool shank and handle.

In FIG. 2, a cross sectional view is shown of one embodiment of the present invention, in which the spaced magnets 12, 14 are generally aligned with the tool axis $A_t$ or axis of the handle 14. In order to provide the equivalent of the space 16 in FIG. 1, a hole 26 is formed in the handle 24 between the magnets 12, 14, such that the tool shank S of a driver tool can be passed through the hole initially through one side and out through the other side of the hole, and subsequently withdrawn from that hole to simulate the action described in connection with FIG. 1. As in FIG. 1, the poles of the magnets 12, 14 facing the hole 26 are both the same, south poles "S" in the example shown. It should be clear, however, that the poles may be reversed so that the north poles "N" face each other across the hole 26.

While the magnet 16 is embedded deep within the handle 26, proximate to the shank T, the other magnet 12 is positioned proximate to the free end of the handle 24, an end cap or cup-shaped cap or cover 28 being provided to enclose or encapsulate and cover the magnet 12 to prevent it from being damaged, as well as serving as a spacer to maintain a desired demagnetizing spacing $d_2$. The cap or cover 28 is preferably made of a nonmagnetizable material, such as aluminum. Other materials, such as plastic, may also be used.

To ensure that the magnetizing fields are substantially greater than the demagnetizing fields, the distance $d_1$ is normally selected to be smaller than the distance $d_2$, for reasons aforementioned. If desired, a notch 30 may be formed in the cap or cover 28 to facilitate the positioning or locating of a shank of a driver tool during demagnetization, for consistent results.

The tool 22 is but one example of the type of tools in connection with which the present invention may be used. The tool 22 is shown as a "fixed" shank driver, in which the shank T is permanently embedded and fixed within the handle 24. Accordingly, the shank T of the tool 22 cannot be magnetized as contemplated by the present invention by the magnets mounted within the handle 24 that supports the same shank. The magnets 12, 14, in this case, can be used to magnetize the shank or shanks of other driver tools that could be readily inserted into the hole 26. To magnetize the shank T of the tool 22 shown in FIG. 2, therefore, that shank would need to be inserted into a corresponding magnetizer arrangement of another driver tool.

As will also be evident from FIGS. 1 and 2, a feature of the invention is that the magnets are so arranged that the magnetizable element or component to be magnetized can be positioned, or swiped across the magnetic axis $A_m$ of the magnets both during magnetization and demagnetization. While the magnetizable component is preferably positionable along the magnetic axis both during magnetization and demagnetization, it will normally suffice if such component can be positioned or swiped proximate to such magnetic axis. Thus, in FIG. 1, the tip T" of the magnetizable shank is shown positioned slightly offset from the magnetic axis $A_m$. In some instances, such offset in the positioning of the magnetizable portion to be demagnetized is desirable in order to either increase the magnetic field, in the case of larger magnetizable objects, or to decrease the demagnetizing field, in the case of smaller magnetizable objects. As explained in connection with FIG. 1, the field conditions with the arrangement shown in FIG. 1 generally provides very much reduced magnetic field intensities along the magnetic axis itself, although the field increases rapidly, slightly "off center." The notch 30 in FIG. 2 can, therefore, be provided as a guide to the user for purposes of positioning the magnetized component at a desired location to provide effective demagnetizing fields. In FIG. 2, as well, the distance $d_1$ is less than the distance $d_2$ to take advantage of the characteristics of the magnetic fields required for magnetization and demagnetization of any given magnetizable component.

As described in connection with FIG. 2, the notch 30 may serve as a guide to the user. As such, it serves as an indicia that ensures that demagnetization can be consistently obtained and repeated if the same sized part or element to be demagnetized is always placed within the groove or notch 30. An important feature of the present invention is the provision of a high energy magnetizer and selective demagnetizer which is mounted on or integral with a driver tool or the like which can provide the appropriate indications or guides to a user for demagnetizing variably sized elements or components to be demagnetized. Thus, referring to FIG. 3, a magnetizer/demagnetizer in accordance with the invention is generally designated by the reference numeral 30. The magnetizer/demagnetizer 30 can either be integrally formed with a non-operative portion of the driver tool or the like or can be provided with suitable means for attaching the same thereto. As shown, the magnetizer/demagnetizer 30 may be in the form of a hemisphere having a generally planar surface 32 and a generally hemispherical surface 34. However, for reasons which will become apparent, the specific configuration of the body forming the magnetizer/demagnetizer 30 is not critical, and numerous shapes and configurations may be used. Preferably, it is desirable that the surface 32 be of a shape or configuration to enable the magnetizer/demagnetizer 30 to be immediately and substantially permanently mounted on a driver tool or the like.

Figure 3:
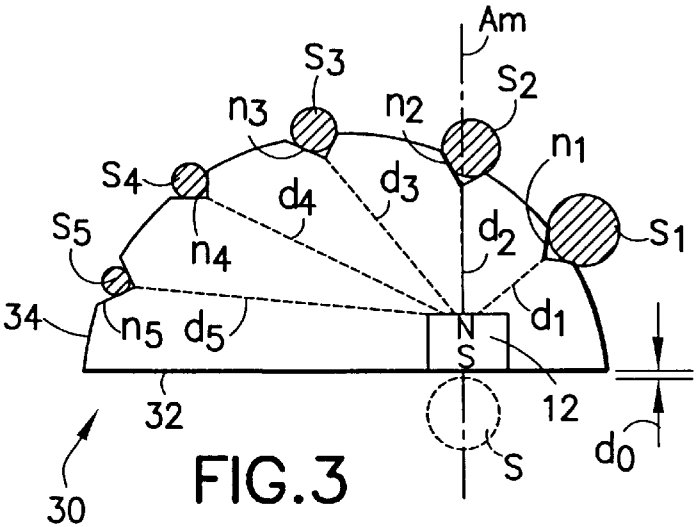
FIG. 3 is a side elevational view of a high energy magnetizer/demagnetizer in accordance with the present invention which defines a generally semicircular or hemispherical surface provided with spaced notches which serve as indicia for positioning variably sized shanks or shafts to be demagnetized.

Likewise, the hemispherical surface 34 can be modified to any other desired surface as long as there are formed external surface portions which can be variably spaced from the magnet 12, as suggested in FIG. 3. In the specific embodiment illustrated, the magnet 12 is embedded within the body of the magnetizer/demagnetizer 30, being positioned adjacently to the surface 32 so that placement of a shaft or shank S adjacent to the magnet 12, generally along its magnetic axis $A_m$, will initially magnetize the shaft or shank when placed a distance $d_0$ from the magnet.

A "non-operative portion of a driving tool or the like" is defined, for purposes of the present invention, to mean a portion of the driving tool or other device which is not critical to the proper functioning or operation of the driver tool or other device so that the driving tool or other device can continued to be used in accordance with its intended function notwithstanding the fact that the magnetizer/demagnetizer is integrally formed or attached thereto. Stated otherwise, making the magnetizer/demagnetizer integral with or attached to the non-operative portion of the driving tool or other device does not materially affect or diminish its operation or usefulness. It is important, therefore, that the element to be demagnetized can be placed at any one of a plurality of selected distances from the magnet 12, each of which is greater than the predetermined or normal distance $d_0$ used for magnetization.

An important feature of the invention is the provision of indicia on the non-operative portion of the driving tool or the like for providing an indication of a desired or preferred position for placement of the magnetizable element S to be demagnetized as a function of the relative size of the portion of the magnetizable element to be demagnetized. Referring to FIG. 3, a series of notches or indentation $n_1$–$n_5$ are illustrated extending about the arcuate surface 34 variably spaced distances $d_1$–$d_5$ from the magnet 12. While each of the notches $n_1$–$n_5$ are shown to be equally sized, it will be clear that these notches can be formed in different shapes and different sizes, with different degrees of advantages. The notches serve as indicia for reliably and repeatably positioning shafts or shanks of the driving tools or other magnetizable elements to be demagnetized. Since bulkier elements to be demagnetized, defining greater volumes of magnetizable material, require stronger demagnetizing fields, a large magnetizable element $S_1$ would normally be placed in notch $n_1$. A smaller magnetizable element $S_2$ would normally be positioned in notch $n_2$, and so on with the smallest magnetizable element $S_5$ being placed in notch $n_5$ at the greatest distance $d_5$ from the magnet 12. The arrangement of such indicia or notches addresses the reality that if large magnetizable elements are demagnetized at a distance that is too great from the demagnetizing pole, the magnetizable element may not be fully demagnetized. Also, a relatively small magnetizable element placed too close to a demagnetizing pole may over-demagnetize and, therefore, re-magnetize with opposing polarity. The distances $d_1$–$d_5$ are preferably selected so that a user can reliably and repeatedly substantially or fully demagnetize the element after it has been magnetized by the magnetizing pole of the magnet 12. The use of the indicia, in the form of notches or indentations, as described, avoids guesswork and insufficient or excessive demagnetization action on the element to be demagnetized.

Figure 4:
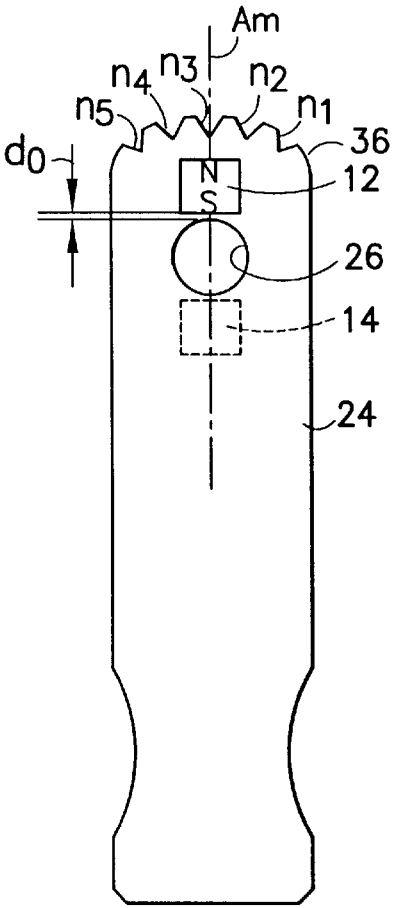
FIG. 4 is a side elevational view of a handle of a driver tool illustrating a series of notches or indentations at the proximate or free end of the driver which serve as indicia for selectively positioning an element to be demagnetized.

As suggested, the indicia in the form or notches or indentations can either be attached to a non-operative portion of a driver tool or the like or may be integrally formed therewith. In FIG. 4 notches $n_1$–$n_5$ are shown in the upper or proximate end of the driver handle 24. The notches are so distributed that the distances of the notches $n_2$ and $n_4$ from the magnet 12 are substantially equal, and the same is true for notches $n_1$ and $n_5$. While there is some redundancy, this provides the user with added flexibility or versatility in the use of the demagnetizer. Thus, while the arcuate surface 34 in FIG. 3 is formed in a separate body that may be attached to a driving tool or the like, the arcuate surface 36 in FIG. 4 is the actual end surface of the driver handle 24.

Figure 5:
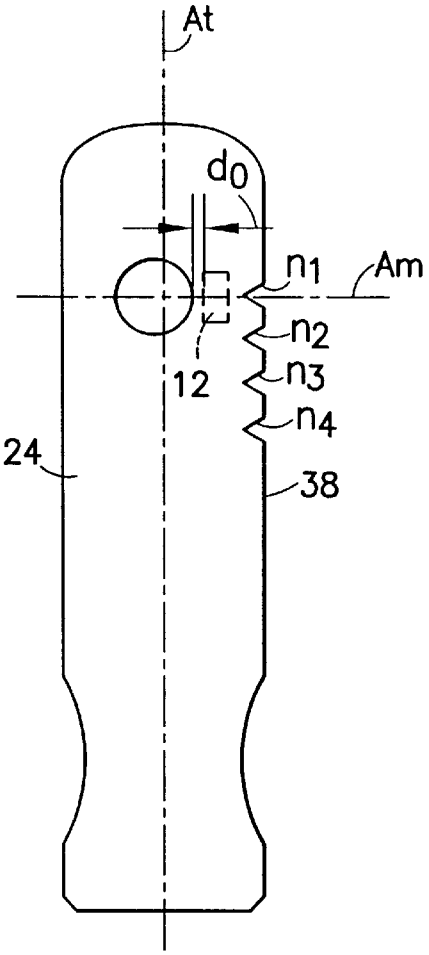
FIG. 5 is similar to FIG. 4, but showing an arrangement of the magnet with its magnetic axis shifted or displaced 90° from the tool axis and the demagnetization indicia are in the form of notches or indentations spaced from each other along the side of the handle.

In FIG. 4, the magnetic axis $A_m$ of the magnet 12 is generally aligned or coextensive with the handle or the tool axis. In FIG. 5 the magnetic axis is rotated 90° from the tool axis $A_t$. Here, the indicia is in the form of notches or indentations $n_1$–$n_4$ arranged on the side surface 38 of the handle 24 to provide the variable or different distances from the magnet 12. In each case, as with the previous embodiments, the resulting demagnetizing distances are each greater than the magnetizing distance $d_0$.

Figure 6:
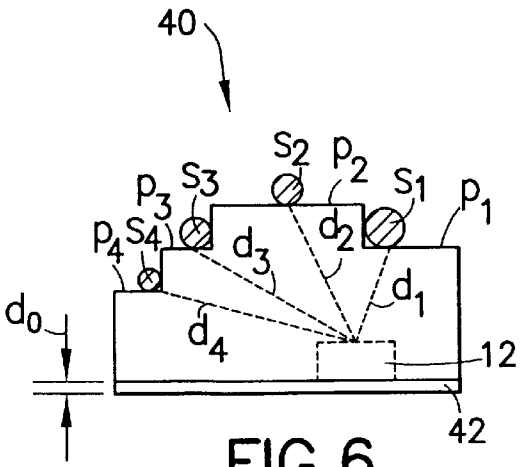
FIG. 6 is similar to FIG. 3, but showing a series or steps or ridges for defining different distances from the demagnetizing pole of the magnet.

In FIG. 6, a magnetizer/demagnetizer 40 is illustrated which is generally similar to the one shown in FIG. 3, except that instead of a hemispherical surface, the body is in the form of a series of steps $s_1$–$s_4$ which can serve as a support or positioning guide for variably sized shanks of driver tools or other magnetizable elements. The body 40 is also provided with a layer of adhesive or adhesive tape 42 that can be used to secure the body 40 to a driving tool or other device. It is clear that with relation to both FIGS. 3 and 6, as many notches or steps can be provided as are necessary or desirable. The number of steps or notches or other indicia should generally be a function of the number different sizes of magnetizable elements anticipated to be used in conjunction with the magnetizer/demagnetizer. Thus, if the magnetizer/demagnetizer is intended to be used, for example, with a kit of screwdrivers or the like which have a predetermined number of different sizes of driver shanks or shafts, an equal number of notches or steps can be used. Therefore, the number of indicia provided is not critical for purposes of the invention.

Figure 7:
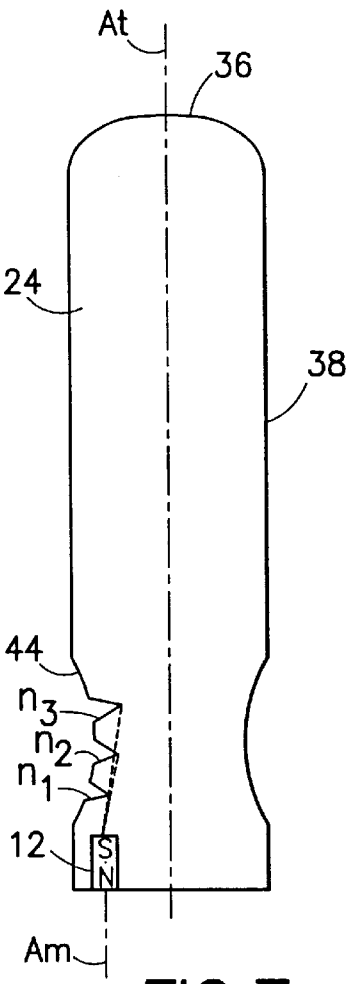
FIG. 7 is similar to FIGS. 4 and 5, in which the indicia in the form of notches or indentations are formed on the side of a handle proximate to the end in which the driver is mounted, the magnet also being situated or positioned at that end.

In FIG. 7, the magnet 12 is positioned at the other or remote end of the handle 24 where the driver shaft or shank is normally attached to the handle. In this instances, the notches or indentations $n_1$–$n_3$ are shown provided along the arcuate indentation proximate to that end so that the different notches are spaced from the magnet 12 along a direction generally parallel to the magnetic axis of the magnet. This is somewhat different than the showing in FIGS. 3–6, in which the indicia are arranged along a direction generally transverse to the magnetic axis. In both instances, however, the distances at which the magnetizable elements are spaced from the demagnetizing poles are different and are selected to provide appropriate levels of demagnetization.

Figure 8:
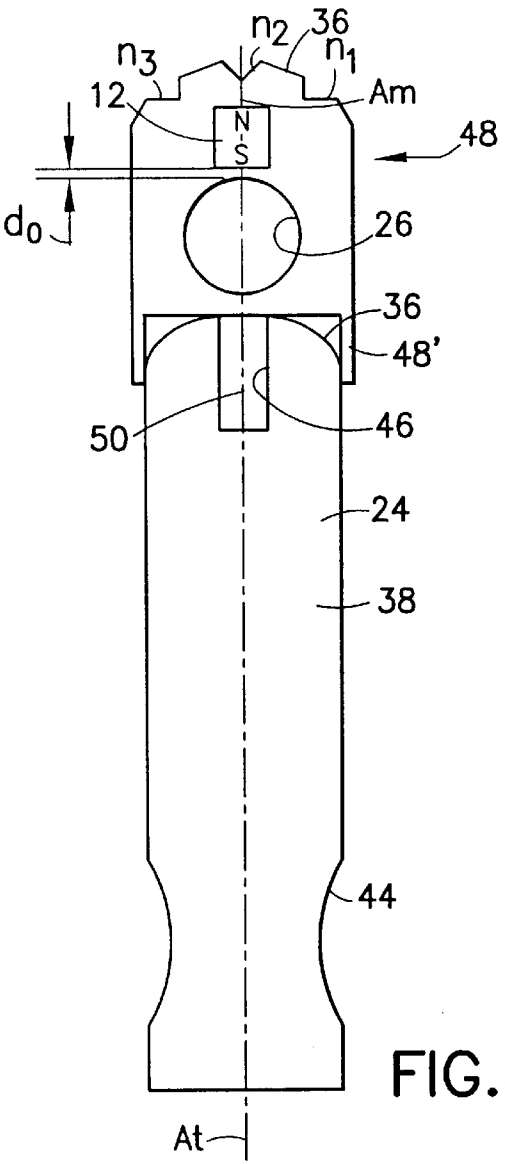
FIG. 8 is similar to FIG. 7, except that the magnetizer/demagnetizer is formed as a separate assembly which is securely mountable on the proximate or free end of the driver handle.

In FIG. 8, a magnetizing/demagnetizing unit 48 is illustrated which is attached to the handle 24 by providing a substantially axial bore or hole 46. The body 48 defines an axis generally coextensive with the tool axis and, in this instance, also with the a magnetic axis. An annular shoulder 48' is provided which contacts the sides of the handle 44 to enhance stability. An axial rod or pin 50 projects from the body 48 dimensioned or configured to be securely receivable within the bore or hole 46 either by means of friction or any suitable adhesive. Aside from being mounted on the handle 24 and not being integral therewith, the magnetizer/demagnetizer 48 provides the same advantages and benefits provided by the previously described embodiments.

In accordance with the broader aspects of the present invention, any indicia may be used which serve as a guide to the user as to the accurate or proper placement of a magnetized element to be demagnetized. Thus, while notches, grooves or steps have been described in connection with the disclosed embodiments, any other forms of indicia may be used. Thus, for example, holes may be drilled within the handle itself, each of which is intended or designed to received another sized magnetized shaft or shank or magnetized element. Also, any suitable printed matter or colored markers may be applied to the surface of the non-operative portion of the driving tool or other device which defines or establishes predetermined or preselected distances from the demagnetizing pole of the magnet. Thus, for example, in place of the notches $n_1$–$n_5$, suitable lines or markers may be imprinted to the surface 34 to designate where the variable shanks $S_1$–$S_5$ need to be placed or positioned in order to position the same variable distances $d_1$–$d_5$ in order to obtain the desired demagnetization effects. Different colored markers or other symbols may also be used on the surface or may be recessed along the demagnetizing surface.

Figure 9:
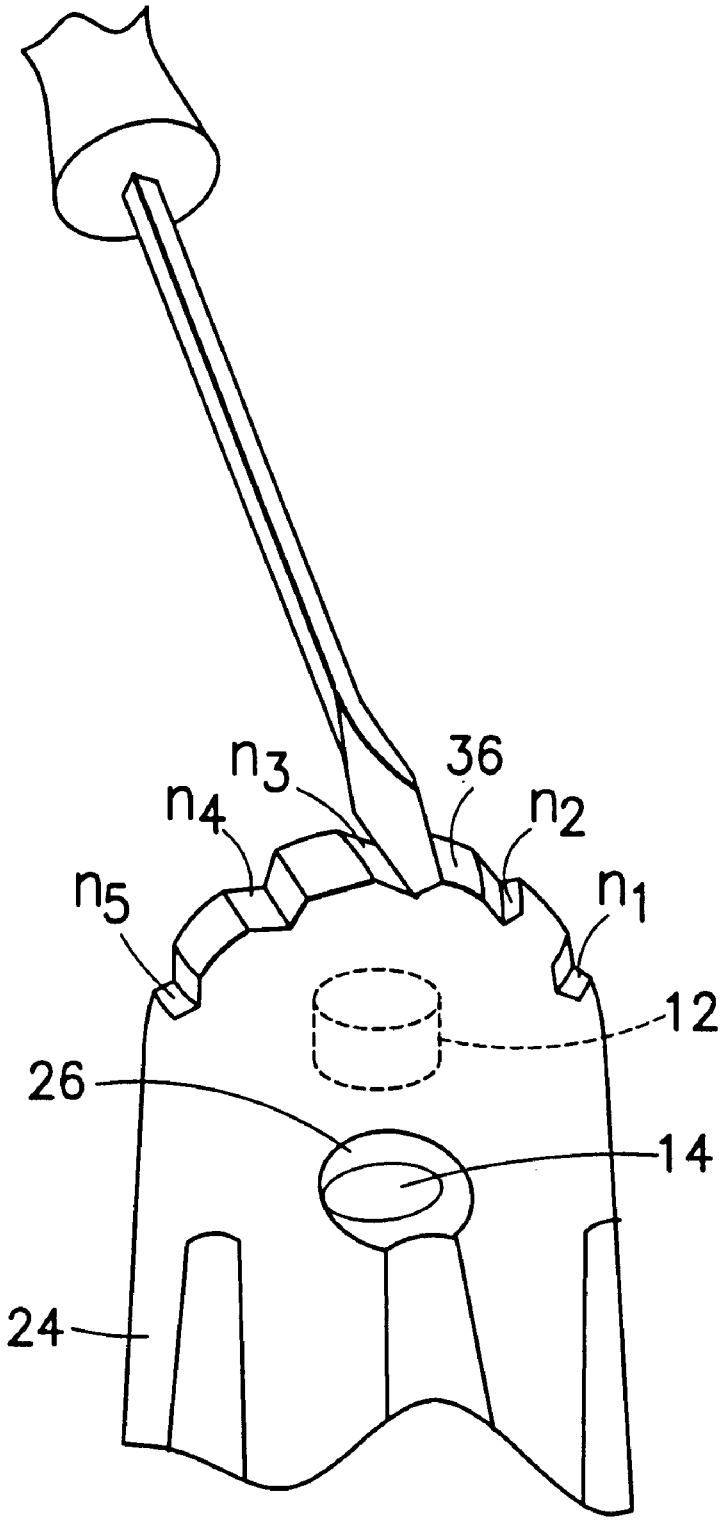
FIG. 9 is a perspective view of the driver handle shown in FIG. 4 and further showing a shank tip in the form of a flat blade screwdriver which is positioned in one of the notches in order to be demagnetized.

In FIG. 9, a tool or shank S of a driving tool T is shown with its driving tip, in the form of a flat screwdriver blade, positioned in the notch $n_3$ to illustrate the manner in which the magnetized portion of the shank S may be demagnetized. A smaller magnetized shaft might be placed in the notches $n_1$, $n_2$, on one side, or $n_4$, $n_5$, on the other side of the notch $n_3$.

The magnetizer/demagnetizer of the present invention may be used in conjunction with any of the described driving tools described in applicant's U.S. patent application Ser. Nos. 08/710,485 (now U.S. Pat. No. 5,794,497), 08/121,221 and 09/144,813, as well as the new filing for "High Energy Magnetizer/Demagnetizer for Drill Housing" filed Sep. 28, 1998, or in conjunction with any other device on which a magnetizer/demagnetizer may be important or useful.

It will be evident, therefore, that there are many possible arrangements of magnets in order to practice the present invention. The specific locations of the magnets on the handle are not critical, and one single magnet or two spaced magnets may be used. However, in order to effectively practice the present invention, it is required or highly desirable that the magnetic materials used have a relatively high energy product and that the magnetizable components can at least be positioned at or proximate to the magnetic axes of the magnets.

An important feature of the present invention is the provision of magnetic means on the handle for establishing a magnetizing magnetic field accessible for selective placement of a magnetizable element within the field, with the magnetic means being formed by a permanently magnetized material having an energy product sufficiently high so that the size and volume of the permanent magnet can be made sufficiently small so that it can be mounted on or embedded within conventionally sized handles, even the generally smaller handles associated and used with precision screwdrivers. Since the magnetic energy content, or BH product, of a magnetic material is proportional to the volume of the magnet, it has been determined that in order to use permanent magnets with small volumes to be mountable on driver tool handles, the magnetic properties of the permanent magnet materials must be equal to at least $7.0\times10^6$ gauss-oersteds. Magnetic flux lines conventionally leave the North Pole and enter the South Pole, the magnetic flux lines being always closed curves that leave the North Pole and enter the South Pole and always maintain the same direction. Therefore, magnetic flux lines generally exhibit the same directions at both Pole surfaces, with the exception that the flux lines leave from the North Pole and enter into the South Pole. The placement of a soft magnetizable material proximate to either of the polar surfaces, therefore, has the same effect on the magnetic domains of the magnetizable material and would tend to either magnetize or demagnetize the magnetizable material at each of the poles. Since both poles have the same effect on a magnetizable element, it is generally necessary to have at least two permanent magnets which are so arranged so as to provide oppositely directed magnetic fields in order to establish reverse polarizing effects on the magnetizable element. Thus, if one of the magnetic poles of one of the permanent magnets provides a magnetizing effect, the other permanent magnet is preferably so arranged so that the placement of the magnetizable element next to one of its poles will have an opposite or demagnetizing effect.

Because conventional magnetic materials that have been used in the past for magnetizing and demagnetizing have had relatively low energy products BH, they could not be embedded or mounted on conventional driver tool handles. Even when attempts to do so have been made, only single bulky and weak magnets could be provided which would normally serve to magnetize components. However, in accordance with the present invention, two or more magnets can now be easily mounted and/or embedded within conventional driver tool handles, even the relatively small precision screwdriver handles, to provide strong magnetizing and demagnetizing fields.

Figure 10:
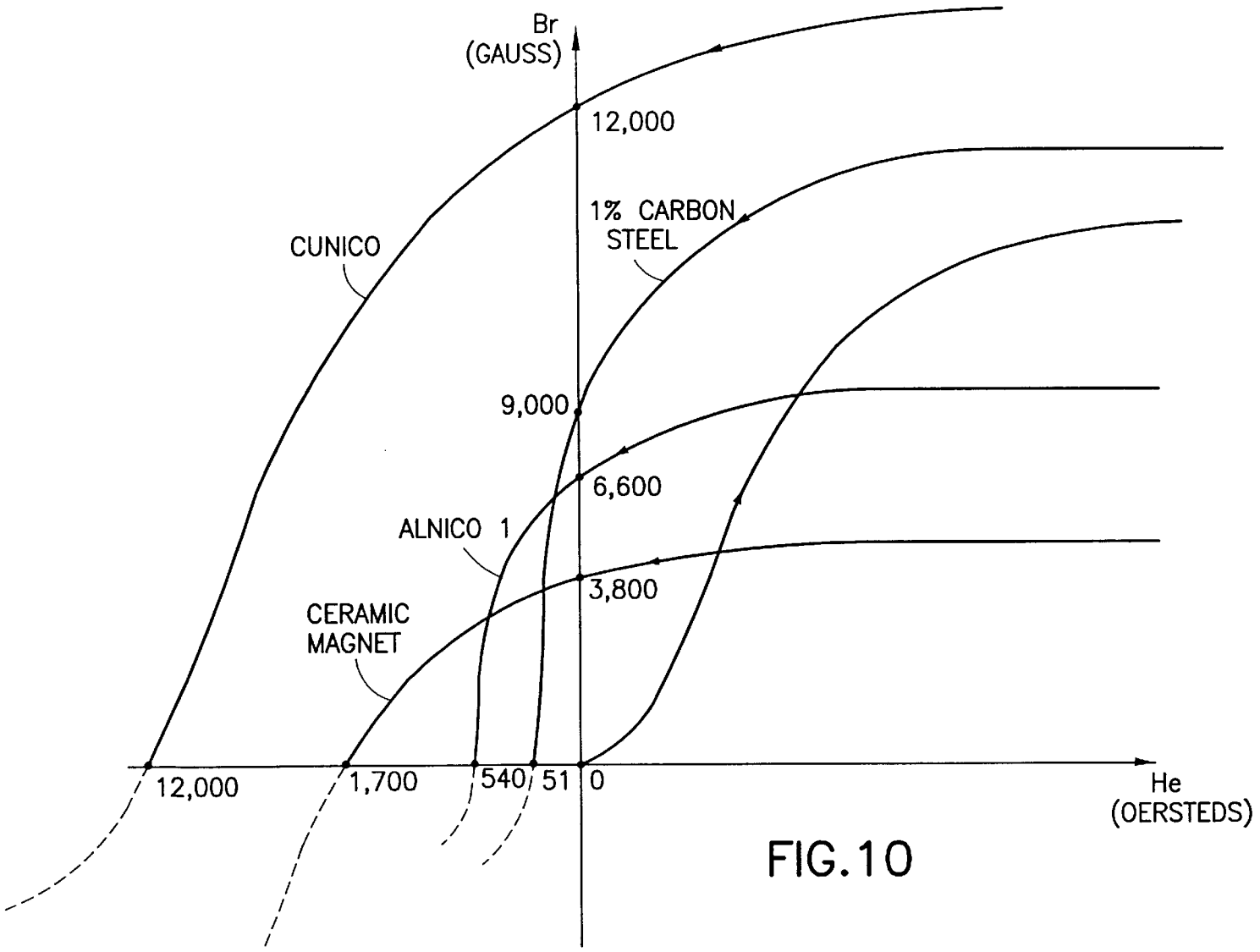
FIG. 10 illustrates partial magnetization curves for some typical or representative magnetizable materials, illustrating the magnetizing force required to initially saturate the magnetic materials and, subsequently, to demagnetize such materials.

Referring to FIG. 10, typical BH curves are illustrated for different magnetizable materials. In each case, with the magnetizable material initially totally demagnetized, the curve M illustrates initial magnetization from the origin, such that as the magnetic intensity H is increased, the flux levels within the materials B are correspondingly increased. While initially such relationship may be relatively linear, magnetic materials saturate at a predetermined level such that increases in magnetic intensity H do not result in additional flux being generated. The remaining curves D1, D2, D3 and D4 illustrate the demagnetizing portions of the B-H curves for different magnetizable materials, namely, cunico, 1% carbon steel, alnico and ceramic magnets. It will be evident that these materials not only have different retentive values $B_r$ (at H=0) but also require different amounts of reverse magnetization in order to totally demagnetize these materials or revert these to the totally demagnetized states in which B=0. Thus, cunico has a retentive field of 12,000 gauss when demagnetizing force is removed and requires −12,000 oersteds to totally demagnetize the material. One-percent carbon steel has a retentive magnetic field of 9,000 gauss when the magnetic intensity is removed, and requires only −51 oersteds to totally demagnetize such steel. Alnico has a somewhat lower retentive field of 6600 gauss, while requiring −540 oersteds to demagnetize the alnico, while a typical ceramic magnet has the lowest retentive field when magnetic intensity is removed, namely 3800 gauss, while a negative intensity of 1700 oersteds is required to demagnetize this material. Therefore, particularly for 1% carbon steel, alnico and ceramic magnets, it will be evident that the reverse magnetic intensities required to fully demagnetize these materials are relative low and substantially less than the intensities required to saturate and fully magnetize these materials. It is for this reason that the distances $d_1$ in each of the embodiments illustrated was selected to be less than the demagnetizing distances $d_2$.

While this invention has been described in detail with particular reference to preferred embodiments thereof, it will be understood that variations and modifications will be effected within the spirit and scope of the invention as described herein and as defined in the appended claims.

What I claim is:

1. A high energy magnetizer/demagnetizer in combination with a non-operative portion of a driving tool or the like, comprising at least one permanent magnet formed of a magnetized material having north and south poles defining a magnetic axis and arranged on the non-operative portion of the driving tool or the like to permit selective placement of a magnetizable element at at least one position along said magnetic axis at a predetermined distance from one of said poles to magnetize the element and placement of the magnetizable element at one of a plurality of selected distances from the other of said magnetic poles each greater than said predetermined distance to selectively demagnetize the element; and indicia means on the non-operative portion of the driving tool or the like for providing an indication of a desired or preferred position for placement of the magnetizable element to be demagnetized as a function of the relative size of the portion of the magnetizable element to be demagnetized, whereby a magnetizable element of a given size may be initially magnetized by positioning same adjacent to one of said poles mounted on the non-operative portion of the driving tool or the like and subsequently substantially or fully demagnetized by positioning the magnetizable element at a selected distance from the other of said poles as indicated by said indicia means.

2. A high energy magnetizer/demagnetizer as defined in claim 1, wherein said at least one magnet has an energy product equal to at least $7.0\times10^6$ gauss-oersteds.

3. A high energy magnetizer/demagnetizer as defined in claim 1, wherein said at least one permanent magnet comprises one permanent magnet provided on the driving tool.

4. A high energy magnetizer/demagnetizer as defined in claim 1, wherein said at least one permanent magnet comprises two permanent magnets provided on the driving tool.

5. A high energy magnetizer/demagnetizer as defined in claim 1, wherein the non-operative portion comprises a portion of an elongate handle defining a tool axis and being suitably shaped and dimensioned to be graspable within the hand of a user and a driver member mounted at one axial end of said handle and defining a driver axis generally co-axially aligned with said tool axis, a hole being provided in said handle sufficiently large to receive a magnetizable element to be magnetized, said permanent magnet being positioned adjacent to said hole to position said one of said poles in proximity to the magnetizable element when passed through said hole.

6. A high energy magnetizer/demagnetizer as defined in claim 5, wherein said hole is generally arranged on said tool axis.

7. A high energy magnetizer/demagnetizer as defined in claim 6, wherein said magnetic axis is offset by 90° from said tool axis.

8. A high energy magnetizer/demagnetizer as defined in claim 7, wherein said at least one permanent magnet comprises two magnets arranged on diametrically opposite sides of said hole and are arranged to provide different distances to the demagnetizing poles at opposite sides of said handle.

9. A high energy magnetizer/demagnetizer as defined in claim 6, wherein said magnetic axis is generally aligned with said driver axis.

10. A high energy magnetizer/demagnetizer as defined in claim 9, wherein said handle has an external configuration to form a plurality of selectable demagnetizing distances with the demagnetizing pole surface, said indicia means serving as positioning guides for each of said demagnetizing distances.

11. A high energy magnetizer/demagnetizer as defined in claim 5, wherein said at least one permanent magnet comprises a single permanent magnet provided with its magnetic axis normal to said tool axis, the magnetizing and demagnetizing pole surfaces being spaced from lateral sides of said handle which form surfaces against which the magnetizable element may be placed.

12. A high energy magnetizer/demagnetizer as defined in claim 1, wherein said at least one permanent magnet comprises two spaced permanent magnets provided on said non-operative portion with aligned magnetic axes and with pole surfaces facing each other having the same polarities.

13. A high energy magnetizer/demagnetizer as defined in claim 1, wherein said at least one permanent magnet comprises two spaced permanent magnets provided on said non-operative portion with aligned magnetic axes and with pole surfaces facing each other having opposite polarities.

14. A high energy magnetizer/demagnetizer as defined in claim 1, wherein said at least one permanent magnet comprises two permanent magnets provided on said non-operative portion and having their magnetic axes substantially parallel to each other and with their pole surfaces of the same polarities facing the same directions along said magnetic axes.

15. A high energy magnetizer/demagnetizer as defined in claim 1, further comprising spacer means made of non-magnetizable material on said at least one driving tool for positioning the magnetizable element a distance from the demagnetizing pole a distance greater than the distance from the magnetizing pole.

16. A high energy magnetizer/demagnetizer as defined in claim 1, wherein said non-operative portion defines a surface proximate to said at least one magnet and having surface portions thereof variably spaced from said at least one magnet, said indicia comprising a plurality of indentations or notches in said surface associated with said surface portions.

17. A high energy magnetizer/demagnetizer as defined in claim 16, wherein said indentations are arranged along a linear direction in relation to said at least one magnet.

18. A high energy magnetizer/demagnetizer as defined in claim 16, wherein said indentations are arranged along an arcuate direction in relation to said at least one magnet.

19. A high energy magnetizer/demagnetizer as defined in claim 16, wherein said non-operative portion is a handle of a driver tool defining a tool axis, said indentations being provided at a free longitudinal end of said handle.

20. A high energy magnetizer/demagnetizer as defined in claim 16, wherein said non-operative portion is a handle of a driver tool defining a tool axis, said indentations being provided along a lateral side of said handle along a line substantially parallel to said tool axis.

21. A high energy magnetizer/demagnetizer as defined in claim 1, wherein the magnetizer/demagnetizer is integrally formed with the non-operative portion of the driver tool or the like.

22. A high energy magnetizer/demagnetizer as defined in claim 1, wherein the magnetizer/demagnetizer is a magnet supporting member having a mounting surface and a demagnetizing positioning surface bearing said indicia means, and further comprising attachment means for substantially permanently attaching the magnet supporting member on a non-operative portion of a driving tool or the like.

23. A high energy magnetizer/demagnetizer as defined in claim 22, wherein said demagnetizing surface is formed of a plurality of steps variably spaced from said other of said magnetic poles.

24. A high energy magnetizer/demagnetizer as defined in claim 22, wherein said demagnetizing surface is curved.

25. A high energy magnetizer/demagnetizer as defined in claim 24, wherein said curved surface is cylindrical.

26. A high energy magnetizer/demagnetizer as defined in claim 24, wherein said curved surface is spherical.

27. A high energy magnetizer/demagnetizer as defined in claim 22, wherein said attachments means comprises adhesive on said mounting surface.

28. A high energy magnetizer/demagnetizer as defined in claim 22, wherein said attachment means comprises a layer of adhesive tape on said mounting surface.

29. A high energy magnetizer/demagnetizer as defined in claim 22, wherein said attachment means comprises at least a mounting post extending from said mounting surface and a hole in the non-operative portion for securely receiving said mounting post.

* * * * *